US011619070B2

(12) United States Patent
Bach

(10) Patent No.: US 11,619,070 B2
(45) Date of Patent: Apr. 4, 2023

(54) CORRAL GATE LATCH RELEASE DEVICE

(71) Applicant: Dennis L. Bach, Pierre, SD (US)

(72) Inventor: Dennis L. Bach, Pierre, SD (US)

( * ) Notice: Subject to any disclaimer, the term of this patent is extended or adjusted under 35 U.S.C. 154(b) by 91 days.

(21) Appl. No.: 17/344,216

(22) Filed: Jun. 10, 2021

(65) Prior Publication Data

US 2022/0396973 A1 Dec. 15, 2022

(51) Int. Cl.
*E05B 65/00* (2006.01)
*E05B 53/00* (2006.01)

(52) U.S. Cl.
CPC ..... *E05B 65/0007* (2013.01); *E05B 53/003* (2013.01)

(58) Field of Classification Search
CPC ..... E05B 65/0007; E05B 53/003; Y10T 292/096; Y10T 292/0969; Y10T 292/1063; Y10T 292/0992; Y10T 292/696; Y10T 292/68; E06B 11/00; E06B 11/085; E06B 11/02; E06B 11/021; E06B 11/022; E06B 11/023; E06B 11/025; E06B 11/026
See application file for complete search history.

(56) References Cited

U.S. PATENT DOCUMENTS 727,139 A 5/1903 Heston
785,059 A * 3/1905 White ..... E05B 65/0007 49/293
859,626 A * 7/1907 Stiokley ..... E06B 11/02 49/294
1,449,262 A * 3/1923 Bishop ..... E06B 11/02 49/292
2,724,199 A * 11/1955 Pringle ..... E06B 11/02 49/245
5,116,090 A 5/1992 Nichandros
7,066,502 B1 * 6/2006 Makus ..... E05B 65/0007 292/166
7,637,541 B2 12/2009 Nesseth
10,385,597 B2 8/2019 Siebert
2007/0052249 A1 * 3/2007 Nesseth ..... E05B 53/003 292/254
2018/0238084 A1 8/2018 Siebert
2020/0378158 A1 * 12/2020 Weber ..... E05B 53/00

FOREIGN PATENT DOCUMENTS

CA 2269480 4/1999
EP 0246213 5/1986

* cited by examiner

*Primary Examiner* — Christine M Mills
*Assistant Examiner* — Christopher F Callahan

(57) ABSTRACT

A corral gate latch release device facilitates quick release of a corral gate latch without a user having to dismount from a horse. The device includes a gate door and a latch coupled to and extending from the gate door. A base post is positioned adjacent to the gate door when the gate door is in a closed position. A latch lock is positioned on the base post to engage the latch when the gate door is in the closed position. A linkage is coupled to the base post and is operationally coupled to the latch lock to disengage the latch lock from the latch. A grip arm is operationally coupled to the linkage to be grasped to move the linkage for disengaging the latch lock from the latch.

15 Claims, 6 Drawing Sheets

CORRAL GATE LATCH RELEASE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to latch release devices and more particularly pertains to a new latch release device for facilitating quick release of a corral gate latch without a user having to dismount from a horse.

(2) Description of Related Art Including Information Disclosed Under 37 CFR 1.97 and 1.98

The prior art relates to latch release devices.

BRIEF SUMMARY OF THE INVENTION

An embodiment of the disclosure meets the needs presented above by generally comprising a gate door and a latch coupled to and extending from the gate door. A base post is positioned adjacent to the gate door when the gate door is in a closed position. A latch lock is positioned on the base post to engage the latch when the gate door is in the closed position. A linkage is coupled to the base post and is operationally coupled to the latch lock to disengage the latch lock from the latch. A grip arm is operationally coupled to the linkage to be grasped to move the linkage for disengaging the latch lock from the latch.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
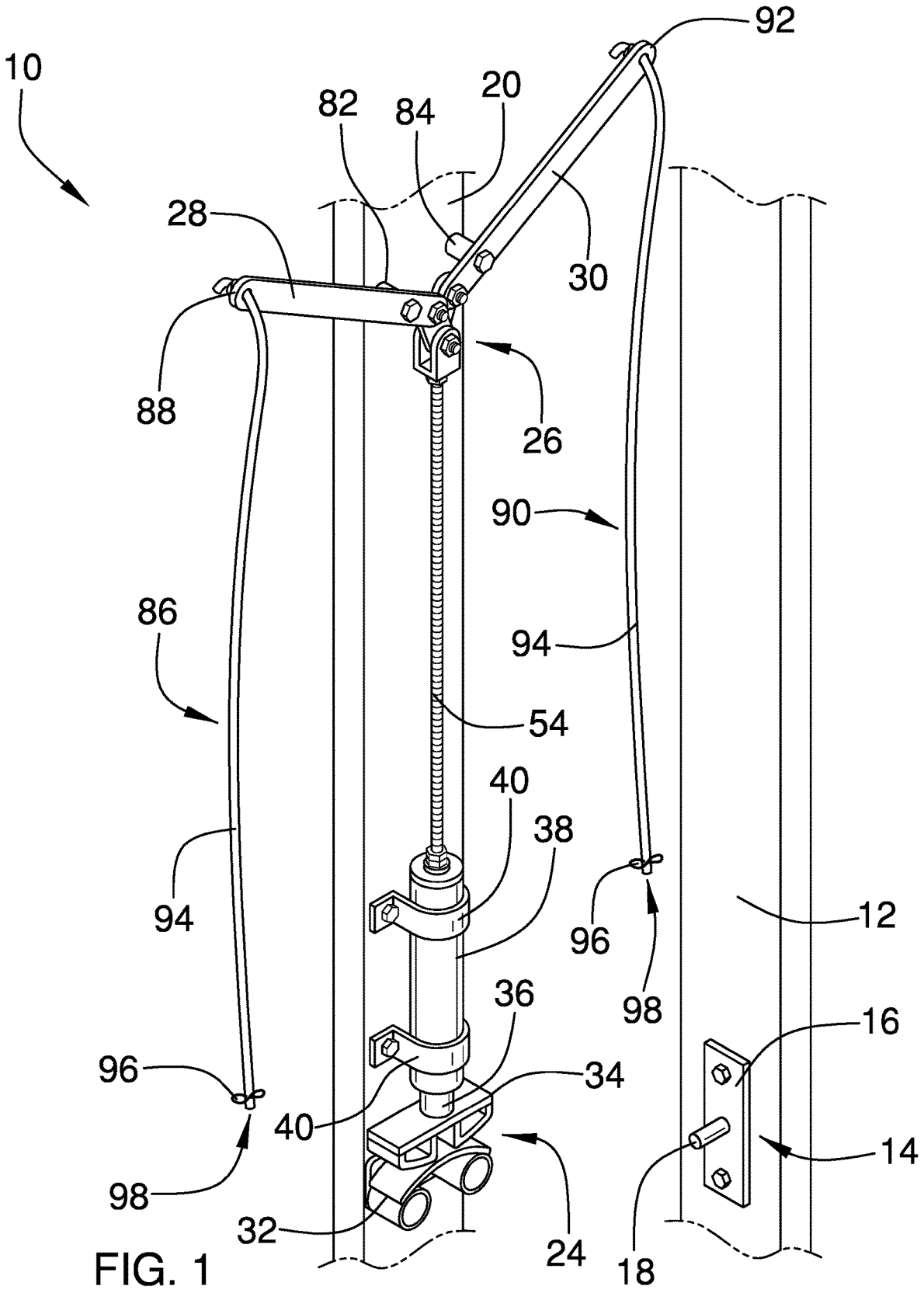
FIG. 1 is a perspective view of a corral gate latch release device according to an embodiment of the disclosure.
Figure 2:
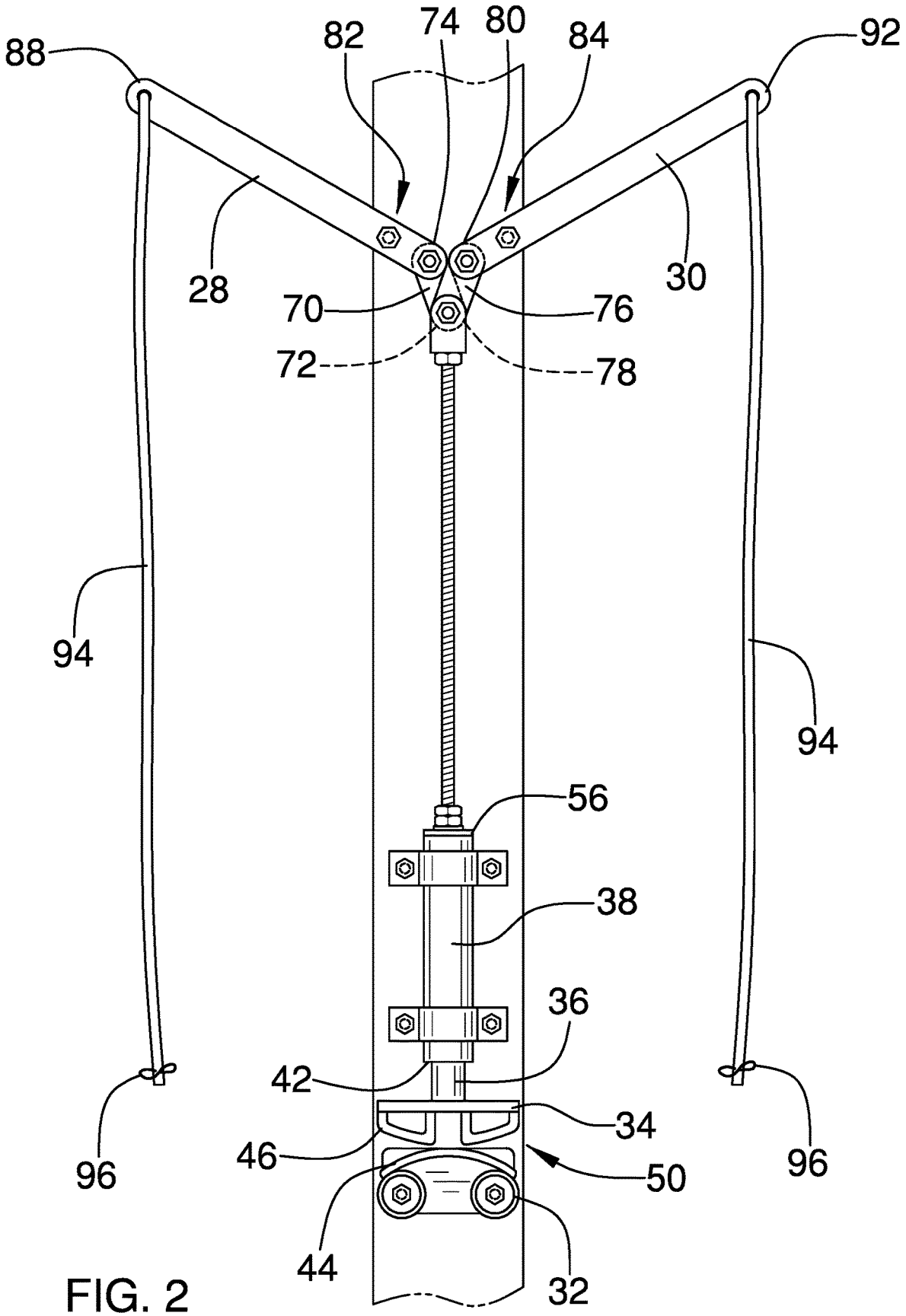
FIG. 2 is a front view of an embodiment of the disclosure.
Figure 3:
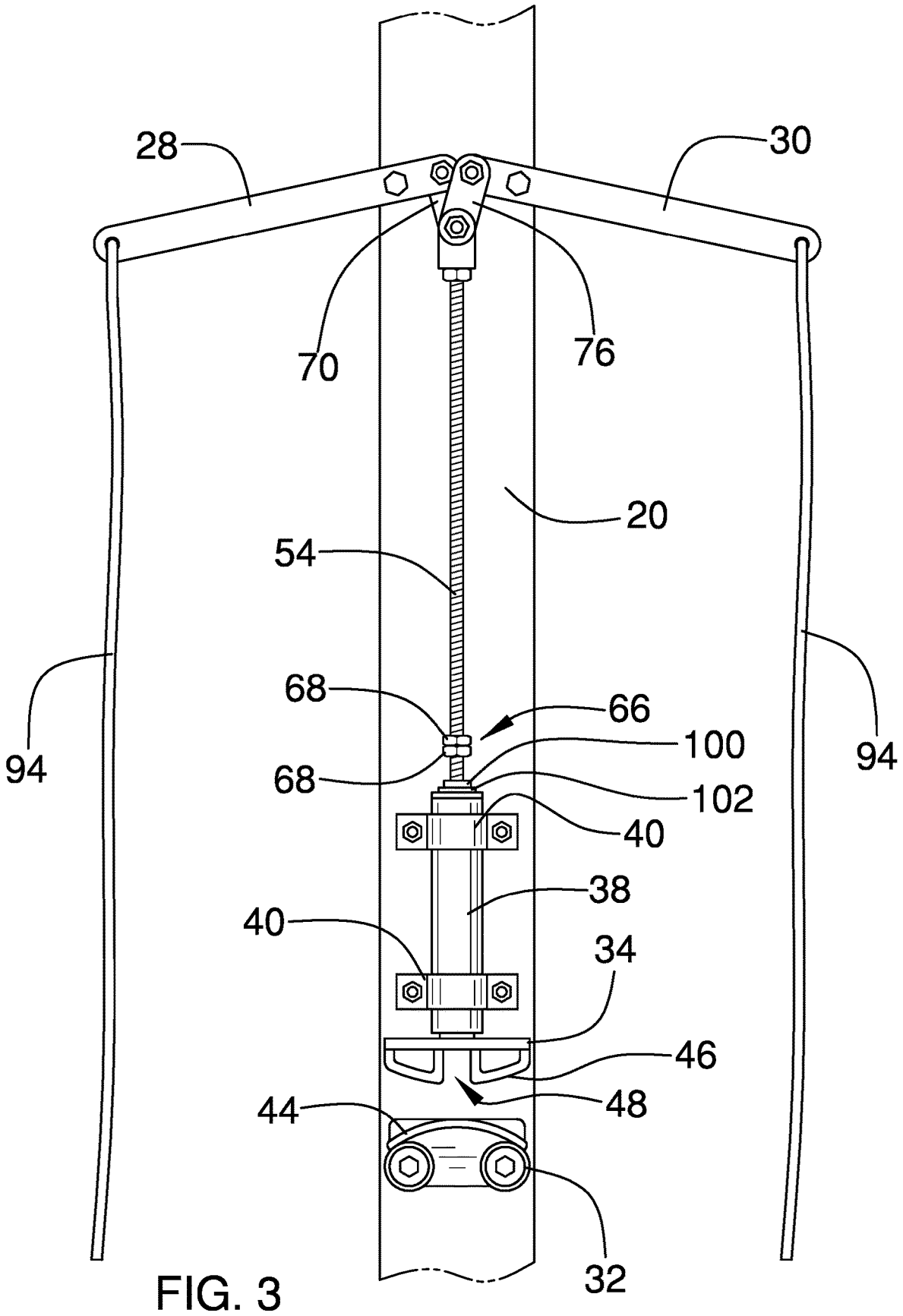
FIG. 3 is a front view of an embodiment of the disclosure.
Figure 4:
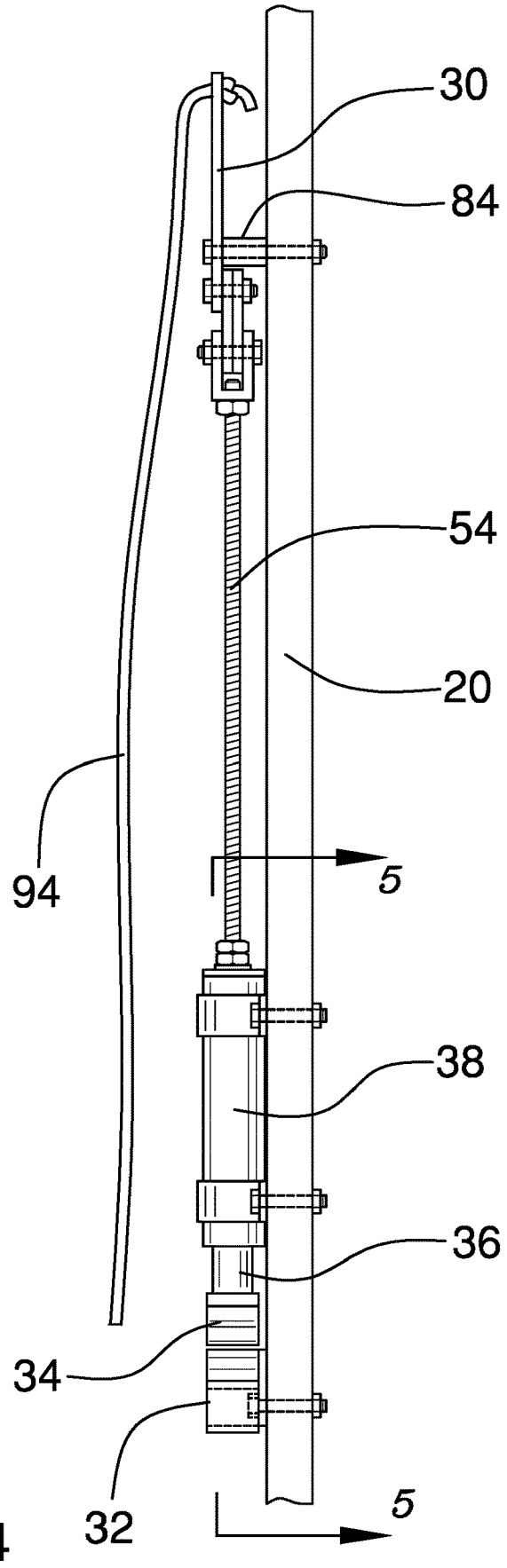
FIG. 4 is a side view of an embodiment of the disclosure.
Figure 5:
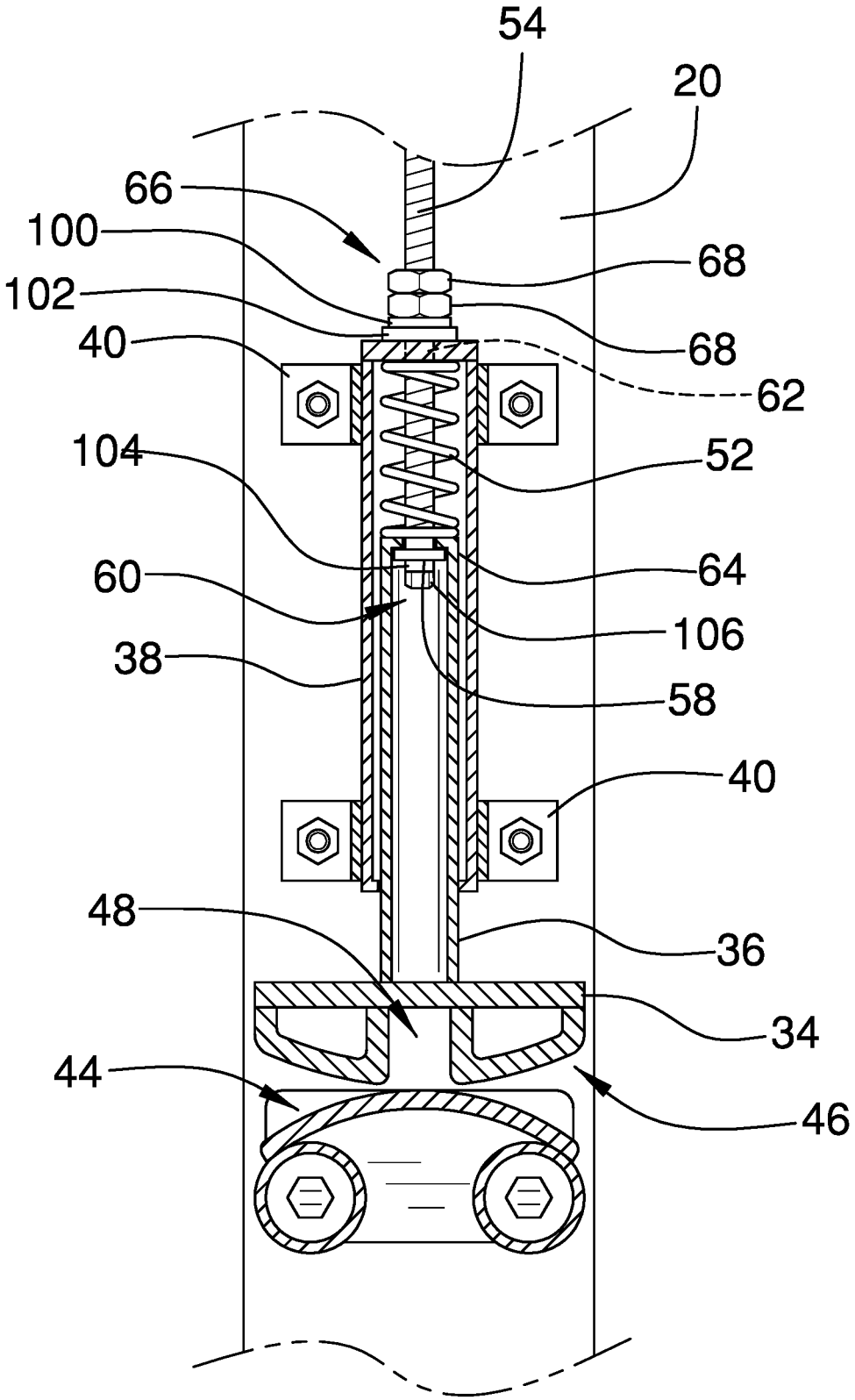
FIG. 5 is a cross-sectional view of an embodiment of the disclosure taken along line 5-5 of FIG. 4.
Figure 6:
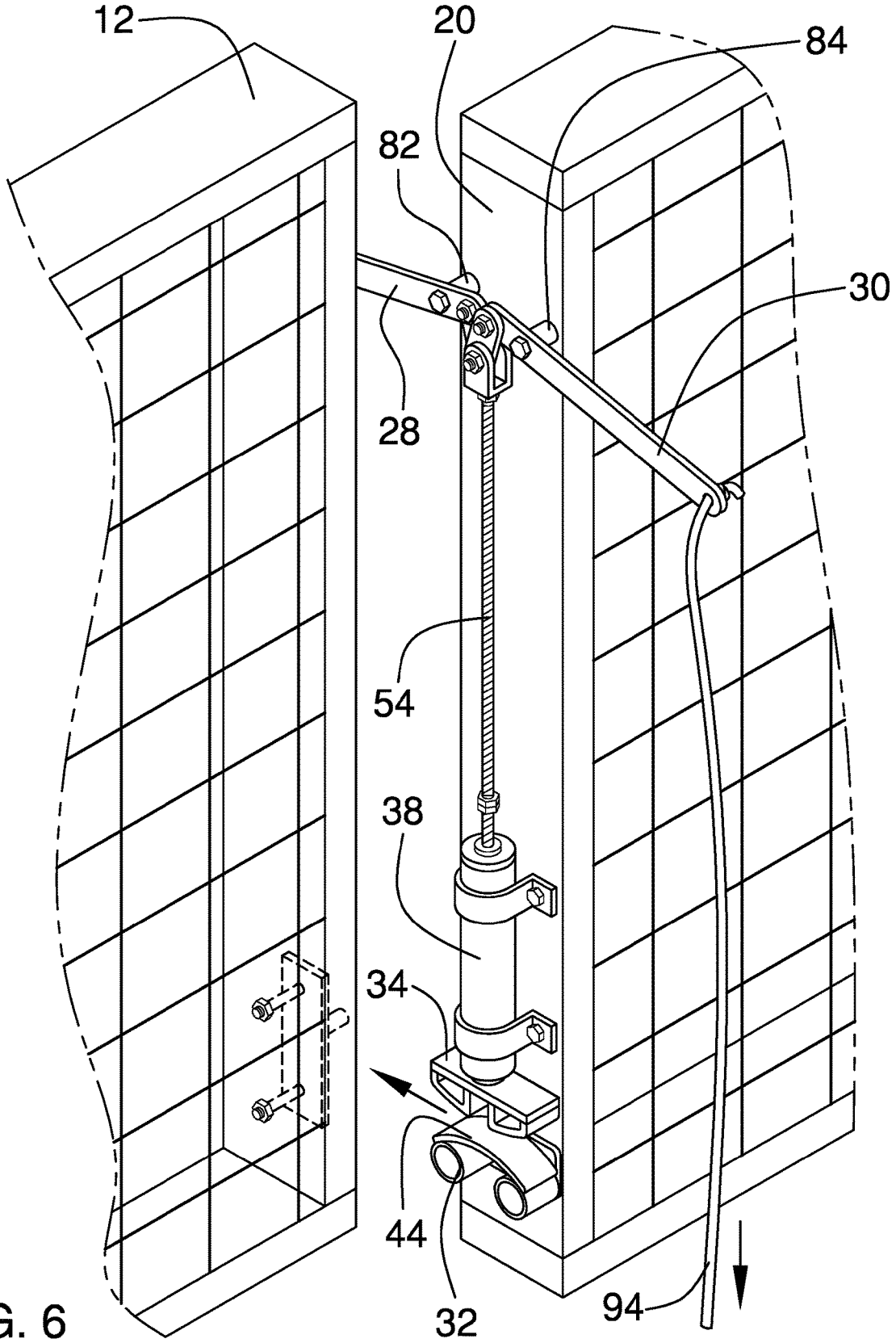
FIG. 6 is a perspective view of an embodiment of the disclosure.

With reference now to the drawings, and in particular to FIGS. 1 through 6 thereof, a new latch release device embodying the principles and concepts of an embodiment of the disclosure and generally designated by the reference numeral 10 will be described.

As best illustrated in FIGS. 1 through 6, the corral gate latch release device 10 generally comprises a gate door 12. A latch 14 is coupled to and extends from the gate door 12. The latch 14 includes a plate 16 and a cylindrical latch bar 18 extending from the plate 16. A base post 20 is positioned adjacent to the gate door 12 when the gate door 12 is in a closed position wherein the latch 14 extends from the gate door 12 towards the base post 20. The base post 20 is typically in a fixed position and defines an edge of an opening into a corral. A latch lock 24 is positioned on the base post 20 wherein the latch lock 24 engages the latch 14 when the gate door 12 is in the closed position. A linkage 26 is coupled to the base post 20. The linkage 26 is operationally coupled to the latch lock 24 wherein the latch lock 24 is movable by operation of the linkage to disengage the latch lock 24 from the latch 14. A first grip arm 28 is operationally coupled to the linkage 26 wherein the first grip arm 28 is configured for being grasped or otherwise manipulated to move the linkage 26 for disengaging the latch lock 24 from the latch 14. The device 10 may having only the first grip arm 28 or may include a second grip arm 30 operationally coupled to the linkage 26. Similar to the first grip arm 28, the second grip arm 30 is configured for being grasped or otherwise manipulated to move the linkage 26 for disengaging the latch lock 24 from the latch 14. The second grip arm 30 extends in an opposite direction from the first grip arm 28 wherein the first grip arm 28 and the second grip arm 30 are positioned on opposite sides of the base post 20. To enhance accessibility the first grip arm 28 and second grip arm 30 would extend outwardly relative to the base post 20 in a direction perpendicular to the gate door 12 when the gate door 12 is in the closed position.

The latch lock 24 includes a fixed section 32 coupled to the base post 20 and an unfixed section 34. The unfixed section 34 is coupled to the base post 20 such that the unfixed section 34 is movable relative to the base post 20, typically positioned to slide vertically. The linkage 26 is coupled to the unfixed section 34. A cylinder 36 is coupled to and extends up from the unfixed section 34. The cylinder 36 moves with the unfixed section 34. A housing 38 is coupled to the base post 20 by brackets 40. The cylinder 36 extends into a lower end 42 of the housing 38. The fixed section 32 has a convex fixed section bearing surface 44 facing the unfixed section 34. The unfixed section 34 has a convex unfixed section bearing surface 46 facing the fixed section 32. This produces facilitates movement of the gate door 12 towards the closed position wherein the latch bar 18 will urge the unfixed section 34 to move as the latch bar 18 is moved between the fixed section 32 and the unfixed section 34. The unfixed section bearing surface 46 has a latch receiver gap 48 wherein the latch bar 18 of the latch 14 is positionable within the latch receiver gap 48. Thus, the latch 14 is inhibited from disengaging the latch lock 24 while the unfixed section 34 is in a locking position 50 adjacent to the fixed section 32.

A spring 52 is mechanically coupled to the unfixed section 34 such that the spring 52 biases the unfixed section 34 towards the fixed section 32. The latch 14 is engaged between the fixed section 32 and the unfixed section 34 within the latch receiver gap 48 when the unfixed section 34 is biased into the locking position 50. The spring 52 is positioned in the housing 38 around a shaft 54 of the linkage 26 such that the spring 52 is compressed between the housing 38 and the cylinder 36. Thus, the spring 52 biases the cylinder 36 towards the fixed section 32 of the latch lock 26.

The linkage 26 includes the shaft 54. The shaft 54 extends into a top end 56 of the housing 38. The shaft 54 is coupled to the cylinder 36 such that manipulation of the first grip arm 28 urges the shaft 54 upwardly to lift the unfixed section 34 of the latch lock 26. A lip 58 is coupled to a base end 60 of the shaft 54. The shaft 54 extends through an opening 62 in an upper end 64 of the cylinder 36. The lip 58 engages the upper end 64 of the cylinder 36 whereby lifting of the shaft 54 lifts the cylinder 36. A linkage adjustment 66 is coupled to the shaft 54. The linkage adjustment 66 is positionable along the shaft 54 to engage the housing 38 such that the linkage adjustment 66 inhibits the shaft 54 from moving into the housing 38 beyond a desired position. The linkage adjustment 66 may be a pair of nuts 68 threadedly engaged to the shaft 54.

The linkage 26 further includes a first shaft arm 70 coupled to and extending between the first grip arm 28 and the shaft 54. The first shaft arm 70 has a first end 72 pivotally coupled to the shaft 54 and a second end 74 pivotally coupled to the first grip arm 28. A second shaft arm 76 is coupled to and extends between the second grip arm 30 and the shaft 54. The second shaft arm 76 has a first end 78 pivotally coupled to the shaft 54 and a second end 80 pivotally coupled to the second grip arm 30. A first grip arm pivot bar 82 is coupled to the base post 20. The first grip arm pivot bar 82 is pivotally coupled to the first grip arm 28 offset from the second end 74 of the first shaft arm 70 wherein pivoting of the first grip arm 28 about the first grip arm pivot bar 82 lifts and lowers the shaft 54 in a vertical direction. Similarly, a second grip arm pivot bar 84 is coupled to the base post 20. The second grip arm pivot bar 84 is pivotally coupled to the second grip arm 30 offset from the second end 80 of the second shaft arm 76 wherein pivoting of the second grip arm 30 about the second grip arm pivot bar 84 lifts and lowers the shaft 54 in the vertical direction.

The device 10 is typically positioned at a height to be accessible to a person while riding a horse. A first grip extension 86 may be coupled to the first grip arm 28. The first grip extension 86 hangs downwardly from the first grip arm 28. The first grip extension 84 hangs from a distal end 88 of the first grip arm 28 relative to the first grip arm pivot bar 82 wherein the first grip extension 86 is laterally spaced from the base post 14. Similarly, a second grip extension 90 is coupled to the second grip arm 30. The second grip extension 90 hangs downwardly from the second grip arm 30. The second grip extension 90 hangs from a distal end 92 of the second grip arm 30 relative to the second grip arm pivot bar 86 wherein the second grip extension 90 is laterally spaced from the base post 14. Each of the first grip extension 86 and the second grip extension 90 may be a respective line 94. The line 94 may be flexible and may be a rope, chain, or the like. The line 94 may have a length sufficient to be manipulated by a person in a wheelchair or the like.

In use, the device 10 facilitates release of the latch 14 from the latch lock 24 by a person on foot or while riding a horse. This facilitates quick exit from a corral when needed, such as when an animal in the corral rushes or chases the person while the person is in the corral. The linkage 26 further returns the unfixed section 34 to the locking position 50 allowing for the gate door 12 to be effectively closed and locked into the closed position by movement of the gate door 12 to the closed position without manipulation of the latch lock.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A corral gate latch release device comprising:

a gate door;

a latch coupled to and extending from said gate door;

a base post positioned adjacent to said gate door when said gate door is in a closed position wherein said latch extends from said gate door towards said base post;

a latch lock, said latch lock being positioned on said base post wherein said latch lock engages said latch when said gate door is in said closed position;

a linkage coupled to said base post, said linkage being operationally coupled to said latch lock wherein said latch lock is movable to disengage said latch lock from said latch;

a grip arm operationally coupled to said linkage wherein said grip arm is configured for being grasped to move said linkage for disengaging said latch lock from said latch;

said latch lock comprising a fixed section coupled to said base post, an unfixed section coupled to said base post such that said unfixed section is movable relative to said base post, said linkage being coupled to said unfixed section, a spring mechanically coupled to said unfixed section such that said spring biases said unfixed section towards said fixed section, and wherein said latch is engaged between said fixed section and said unfixed section when said unfixed section is biased into a locking position adjacent to said fixed section;

said latch lock including a housing coupled to said base post;

said unfixed section being coupled to a cylinder, said cylinder extending into a lower end of said housing; and said linkage including a shaft, said shaft extending into a top end of said housing, said shaft being coupled to said cylinder such that manipulation of said grip to urge said shaft upwardly lifts said unfixed section of said latch lock.

2. The corral gate latch release device of claim 1, further comprising:

said fixed section having a convex fixed section bearing surface facing said unfixed section; and said unfixed section having a convex unfixed section bearing surface facing said fixed section, said unfixed section bearing surface having a latch receiver gap wherein said latch is positionable within said latch receiver gap whereby said latch is inhibited from disengaging said latch lock while said unfixed section is in said locking position.

3. The corral gate latch release device of claim 1, further comprising a lip coupled to a base end of said shaft, said shaft extending into an opening in an upper end of said cylinder; said lip engaging said upper end of said cylinder whereby lifting of said shaft lifts said cylinder.

4. The corral gate latch release device of claim 2, further comprising said spring being positioned in said housing around said shaft of said linkage such that said spring is compressed between said housing and said cylinder whereby said spring biases said cylinder towards said fixed section of said latch lock.

5. The corral gate latch release device of claim 1, further comprising a linkage adjustment coupled to said shaft, said linkage adjustment being positionable along said shaft to engage said housing such that said linkage adjustment inhibits said shaft from moving into said housing.

6. The corral gate latch release device of claim 5, further comprising said linkage adjustment being a pair of nuts threadedly engaged to said shaft.

7. The corral gate latch release device of claim 1, wherein said linkage further comprises:

a shaft arm coupled to and extending between said grip arm and said shaft, said shaft arm having a first end pivotally coupled to said shaft and a second end pivotally coupled to said grip arm; and a grip arm pivot bar coupled to said base post, said grip arm pivot bar being pivotally coupled to said grip arm offset from said second end of said shaft arm wherein pivoting of said grip arm about said grip arm pivot bar lifts and lower said shaft in a vertical direction.

8. The corral gate latch release device of claim 7, further comprising:

said shaft arm being a first shaft arm, said grip arm being a first grip arm, and said grip arm pivot bar being a first grip arm pivot bar;

a second grip arm coupled to said shaft, said second grip arm extending from said shaft in an opposite direction from said first grip arm wherein said first grip arm and said second grip arm are positioned on opposite sides of said base post;

a second shaft arm coupled to and extending between a second grip arm and said shaft, said second shaft arm having a first end pivotally coupled to said shaft and a second end pivotally coupled to said second grip arm; and a second grip arm pivot bar coupled to said base post, said second grip arm pivot bar being pivotally coupled to said second grip arm offset from said second end of said second shaft arm wherein pivoting of said second grip arm about said second grip arm pivot bar lifts and lower said shaft in a vertical direction.

9. The corral gate latch release device of claim 8, further comprising:

a first grip extension coupled to said first grip arm, said first grip extension hanging downwardly from said first grip arm; and a second grip extension coupled to said second grip arm, said second grip extension hanging downwardly from said second grip arm.

10. The corral gate latch release device of claim 9, further comprising:

said first grip extension hanging from a distal end of said first grip arm relative to said first grip arm pivot bar wherein said first grip extension is laterally spaced from said base post; and, said second grip extension hanging from a distal end of said second grip arm relative to said second grip arm pivot bar wherein said second grip extension is laterally spaced from said base post.

11. The corral gate latch release device of claim 9, further comprising each of said first grip extension and said second grip extension being a respective line.

12. The corral gate latch release device of claim 1, further comprising a grip extension coupled to said grip arm, said grip extension hanging downwardly from said grip arm.

13. The corral gate latch release device of claim 12, further comprising said grip extension located at a distal end of said grip arm relative to a grip arm pivot bar wherein said grip extension is laterally spaced from said base post.

14. The corral gate latch release device of claim 12, further comprising said grip extension being a line.

15. A corral gate latch release device comprising:

a gate door;

a latch coupled to and extending from said gate door;

a base post positioned adjacent to said gate door when said gate door is in a closed position wherein said latch extends from said gate door towards said base post;

a latch lock, said latch lock being positioned on said base post wherein said latch lock engages said latch when said gate door is in said closed position;

a linkage coupled to said base post, said linkage being operationally coupled to said latch lock wherein said latch lock is movable to disengage said latch lock from said latch; and a first grip arm operationally coupled to said linkage wherein said first grip arm is configured for being grasped to move said linkage for disengaging said latch lock from said latch;

a second grip arm operationally coupled to said linkage wherein said second grip arm is configured for being grasped to move said linkage for disengaging said latch lock from said latch, said second grip arm extending in an opposite direction from said first grip arm wherein said first grip arm and said second grip arm are positioned on opposite sides of said base post;

said latch lock comprising a fixed section coupled to said base post;

an unfixed section coupled to said base post such that said unfixed section is movable relative to said base post, said linkage being coupled to said unfixed section, a cylinder coupled to and extending up from said unfixed section, said cylinder moving with said unfixed section, a housing coupled to said base post, said cylinder extending into a lower end of said housing, said fixed section having a convex fixed section bearing surface facing said unfixed section, said unfixed section having a convex unfixed section bearing surface facing said fixed section, said unfixed section bearing surface having a latch receiver gap wherein said latch is positionable within said latch receiver gap whereby said latch is inhibited from disengaging said latch lock while said unfixed section is in a locking position adjacent to said fixed section, a spring mechanically coupled to said unfixed section such that said spring biases said unfixed section towards said fixed section, wherein said latch is engaged between said fixed section and said unfixed section when said unfixed section is biased into said locking position, said spring being positioned in said housing around a shaft of said linkage such that said spring is compressed between said housing and said cylinder whereby said spring biases said cylinder towards said fixed section of said latch lock;

said linkage comprising said shaft, said shaft extending into a top end of said housing, said shaft being coupled to said cylinder such that manipulation of said first grip arm to urge said shaft upwardly lifts said unfixed section of said latch lock, a lip coupled to a base end of said shaft, said shaft extending through an opening in an upper end of said cylinder, said lip engaging said upper end of said cylinder whereby lifting of said shaft lifts said cylinder;

a linkage adjustment coupled to said shaft, said linkage adjustment being positionable along said shaft to engage said housing such that said linkage adjustment inhibits said shaft from moving into said housing, said linkage adjustment being a pair of nuts threadedly engaged to said shaft, a first shaft arm coupled to and extending between said first grip arm and said shaft, said first shaft arm having z first end pivotally coupled to said shaft and a second end pivotally coupled to said first grip arm, a second shaft arm coupled to and extending between a second grip arm and said shaft, said second shaft arm having a first end pivotally coupled to said shaft and a second end pivotally coupled to said second grip arm, a first grip arm pivot bar coupled to said base post, said first grip arm pivot bar being pivotally coupled to said first grip arm offset from said second end of said first shaft arm wherein pivoting of said first grip arm about said first grip arm pivot bar lifts and lower said shaft in a vertical direction;

a second grip arm pivot bar coupled to said base post, said second grip arm pivot bar being pivotally coupled to said second grip arm offset from said second end of said second shaft arm wherein pivoting of said second grip arm about said second grip arm pivot bar lifts and lower said shaft in a vertical direction;

a first grip extension coupled to said first grip arm, said first grip extension hanging downwardly from said first grip arm, said first grip extension hanging from a distal end of said first grip arm relative to said first grip arm pivot bar wherein said first grip extension is laterally spaced from said base post; and a second grip extension coupled to said second grip arm, said second grip extension hanging downwardly from said second grip arm, said second grip extension hanging from a distal end of said second grip arm relative to said second grip arm pivot bar wherein said second grip extension is laterally spaced from said base post, each of said first grip extension and said second grip extension being a respective line.

* * * * *